United States Patent [19]

Webster et al.

[11] 4,222,513

[45] Sep. 16, 1980

[54] CENTRIFUGE TUBE SEAL

[75] Inventors: Donald A. Webster, Fairfield; Lake H. Johnson, Newtown; William A. Romanauskas, Southbury, all of Conn.

[73] Assignee: E. I. Du Pont de Nemours and Company, Wilmington, Del.

[21] Appl. No.: 968,965

[22] Filed: Dec. 12, 1978

[51] Int. Cl.[2] ..... B04B 15/00

[52] U.S. Cl. ..... 233/26; 233/1 A

[58] Field of Search ..... 233/26, 1 R, 1 A; 150/8; 23/292

[56] References Cited

U.S. PATENT DOCUMENTS

| | | | |
|---|---|---|---|
| 3,434,615 | 3/1969 | Barletta | 233/26 X |
| 3,459,369 | 8/1969 | Marks | 233/26 |
| 3,938,735 | 2/1976 | Wright | 233/26 |
| 4,076,170 | 2/1978 | Chulay et al. | 233/26 |
| 4,080,175 | 3/1978 | Chulay et al. | 233/26 X |
| 4,087,043 | 5/1978 | Anderson et al. | 233/26 |
| 4,114,803 | 9/1978 | Romanauskas | 233/26 |

*Primary Examiner*—George H. Krizmanich

[57] ABSTRACT

A vertically oriented centrifuge tube is placed in a rotor cavity and the open end sealed with a tapered plug. A resilient O-ring is placed in an annular groove formed in the top of the tapered plug and a retaining disc, secured to the open end of the cavity, wedges the plug into the open end of the centrifuge tube. The O-ring, being resilient, maintains an axial force which aids in retaining the tapered plug properly seated within the open end of the centrifuge tube, even during and following the stresses of centrifugation.

8 Claims, 5 Drawing Figures

CENTRIFUGE TUBE SEAL

CROSS REFERENCE TO OTHER APPLICATION

Other apparatus for providing a seal for centrifuge tubes is described and claimed in an application Ser. No. 856,234, filed Dec. 1, 1977 (IP-0150). The above application is assigned to the same assignee as this application.

BACKGROUND OF THE INVENTION

This invention relates to an apparatus for sealing centrifuge tubes and, more particularly, to an apparatus for sealing centrifuge tubes mounted in rotor cavities.

There is described in U.S. Pat. No. 3,998,542, issued Dec. 19, 1977 to Romanauskas et al. a cap seal for a vertically oriented centrifuge tube. Vertically oriented tubes are particularly useful in density gradient separations in which the density gradient is reoriented from vertical to horizontal and back to vertical for fractionation.

Centrifuge tube caps prior to those devised by Romanauskas et al. typically were comprised of three parts. Although quite satisfactory for most centrifuge applications, these prior art caps could not be used with vertically oriented tubes because the caps tended to be forced off by the hydrostatic pressure developed in the tubes during centrifugation.

The cap seal described by Romanauskas et al. is one in which a tapered plug is introduced into a centrifuge tube disposed in a rotor cavity having a flared mouth. A threaded disc is screwed into the open end of the tube cavity and bears axially against the plug so as to wedge the wall of the tube between the plug and the flared mouth of the rotor cavity. A somewhat similar cap seal construction, although apparently not for density gradient separations, is described in an article entitled "A Quantity Type Rotor for the Ultracentrifuge", by A. Victor Masket, *Review of Scientific Instruments*, May 1941, Vol. 12, Pg. 277–279.

Because of the resiliency of the tube, Romanauskas et al. provide a relatively strong, leak proof seal that is effective even under the large pressure forces which occur during the centrifugation of vertically oriented tubes. While this seal performs quite satisfactorily, as the diameter of the tubes increase, leakage can sometimes occur, particularly with larger diameter tubes, i.e., those exceeding two to three centimeters and more. The leakage problem increases as a function of the diameter of the tube, rotor speed and attitude of the tube, i.e., as the tube approaches the vertical, or is parallel to the rotational axis, the pressures exerted on the tube cap increase appreciably.

Unfortunately, as the centrifuge rotor is operated at higher speeds (typically above 50,000 rpm), the plug, which typical is formed of one of the rigid plastics, tends to be deformed by centrifugal force, that is, it is no longer round. In addition, cold flow of the centrifuge tube itself tends to cause the tube's thickness to vary. These two factors reduce the ability of the tapered plug to maintain a seal. As a result, the contents of the tube often leak causing a vacuum loss. This leakage can cause automatic shutdown of a centrifuge run, rotor imbalance and even an explosion in extreme cases. Even if the original seal is maintained at high speeds, the plug, because of its deformed shape, often permits leakage as the rotor is slowed in speed.

Accordingly, the need exists for a reliable seal for a centrifuge tube that reduces the chance of leakage, even with relatively large diameter tubes.

It is therefore an object of this invention to provide an improved seal for a centrifuge tube.

A further object of this invention is to provide an improved seal for vertically oriented centrifuge tubes.

SUMMARY OF THE INVENTION

A centrifuge rotor, for centrifuging a sample in a flexible container having an open end and a first tapered plug for sealing the open end, has a rotational axis and a radially spaced cavity with a flared open end for the container. The cavity has an axis through the open end generally parallel to the rotational axis of the rotor. A retainer is secured to the open cavity end for wedging the walls of the open end of the container between the tapered plug and the cavity flare. According to this invention, a resilient member is disposed on the cavity axis between the container and plug on the one hand and one of the cavity and retainer on the other, thereby to provide an axial force wedging the plug into the container.

In one aspect of the invention, the resilient member is an O-ring and an annular groove is formed in the top surface of the plug for receiving and supporting the O-ring against the radial displacement. Preferably, the volume of the groove equals that of the O-ring and the depth of the groove is less than the diameter of the O-ring.

In alternative embodiments of the invention, the resilient member may be a flat washer or a disc. The disc may be disposed either on top of the plug, between the plug and retainer, or between the bottom of the tube and the bottom of the cavity. Either location permits the compressed resilient member to provide the axial force which permits the tapered plug to seat itself as needed to maintain the proper seal against leakage despite distortions of the plug under the influence of centrifugal force.

BRIEF DESCRIPTION OF THE DRAWINGS

Further advantages and features of this invention will become apparent upon consideration of the following description wherein.

DESCRIPTION OF THE PREFERRED EMBODIMENT

While the apparatus of this invention may be used with any centrifuge rotor in which tubes are positioned in rotor cavities, it finds particular use with a vertical tube rotor. In a vertical tube rotor, the sample tubes or containers are generally vertically oriented for rotation about a vertical spin axis. Utilizing such vertical orientation has many advantages. Among these are short path lengths (the diameter of the tubes), and hence a relatively steep separation gradient during centrifugation, and a relatively long path length during recovery, i.e., relatively wide separation of bands. Vertical tube rotors and their advantages are described more fully in the said Romanauskas et al. patent.

Figure 1:
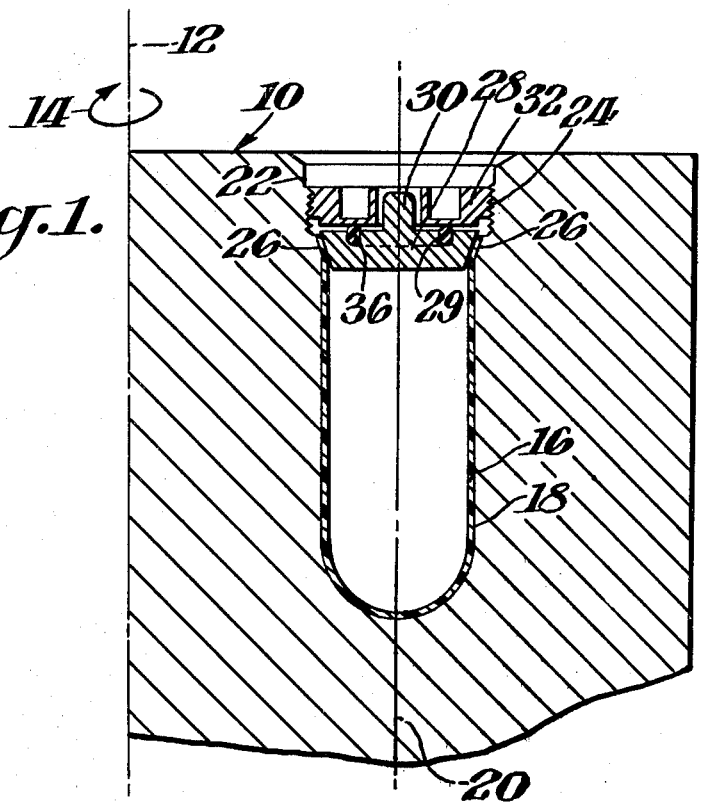
FIG. 1 is a fragmentary, cross sectional elevation view of a centrifuge rotor, partly in schematic, typifying a vertically oriented sample container adapted to be sealed utilizing a rotor seal constructed in accordance with one embodiment of this invention.

Such a vertically oriented rotor is depicted in FIG. 1 in which there is a fragmentary view of a rotor 10 adapted to be spun about a spin axis 12 in what is illustrated as a clockwise sense, depicted by the arrow 14. The rotor is adapted to hold a plurality (only one of which is shown) of circumferentially spaced sample tubes or containers 16. Each tube is adapted to be inserted into a corresponding vertically oriented cavity 18, formed within the rotor 10, with a sliding fit. The cavity 18 preferably has a vertical axis 20 which is generally parallel to and, when the rotor rotates, spins about the vertically oriented spin axis 12. The rotor is adapted to be driven by any suitable drive means such as a motor or other conventional prime mover (not shown). The tube 16, which may be elongated, is formed of any of the conventional resilient materials that are used for centrifuge tubes. These materials include the polyallomers, cellulose nitrate, nylon and polypropylene. Any other suitably resilient material, as will be described hereinafter, may be used as well.

The top of the cavity 18 is formed with a counterbore 22 which is internally threaded as at 24. The shoulder formed between the counterbore 22 and the cavity 18 is located at a point corresponding to the lip or open end of the tube 16. This shoulder or upper portion of the cavity 18 is slanted outwardly or flared as at 26 to accommodate a tapered plug 28. The plug may have a stem 30 to facilitate its removal following centrifugation. The plug may be formed of any suitable strong, lightweight material such as aluminum or one of the acetal resins, such as Delrin* resin. Delrin is a trademark of E. I. du Pont de Nemours and Company, Wilmington, Delaware. A retaining disc or retainer 32 in the form of an annular ring or hollow disc engages the threads 24 and loosely fits over a stem 30 on the plug.

Figure 2:
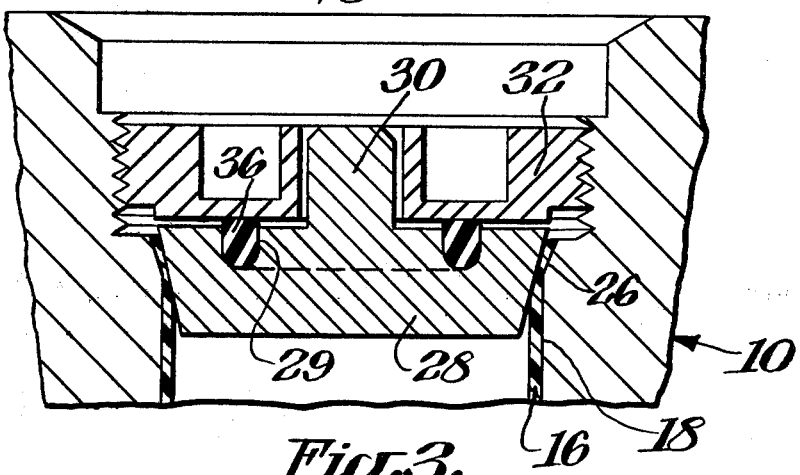
FIG. 2 is a fragmentary, cross sectional elevation view of the O-ring rotor seal depicted in FIG. 1, but in an operated condition, i.e., with the O-ring compressed.

As shown in FIG. 2, the retainer, when tightened, urges the plug axially downward into the cavity 18 so as to wedge the thin resilient walls of the tube 16 between the taper of the plug and the shoulder flare 26. The resilience of the tube 16 provides a fluid tight seal that is relatively secure and permits rotor speeds up to 65,000 revolutions per minute (rpm) and above. Lateral movement of the plug 28 within the limits permitted by the resilience of the tube walls is permitted by the loose fit of the stem 30 and the retainer 32. When completely assembled, there should be a clearance between the shoulder 26 and the retainer 32.

In accordance with a preferred embodiment of this invention, the tapered plug 28 is formed with an annular groove 29 having a generally semicircular cross section in its top surface. An O-ring 36 is positioned in the groove 29. The volume of the groove should approximate that of the volume of the torus of the O-ring, yet the depth of the groove should be less than the diameter of the torus of the O-ring 36 such that the O-ring protrudes above the top surface of the groove. Actually, the groove may have a rectangular cross section, but the circular cross section is preferred.

Under these conditions, when the retaining disc 32 is tightened, it contacts the O-ring causing it to be compressed into the groove 29 such that a constant force is maintained urging the plug 28 into the open end of the tube thus wedging the walls of the tube between the tapered plug and the shoulder flare 26. Thus, during operation, even though the plug itself or the container may distort to some extent, the constant axial force afforded by the compressed O-ring permits the plug to seat itself and maintain a fluid tight seal. The seal is maintained at high operating speeds as well as during deceleration.

Figure 3:
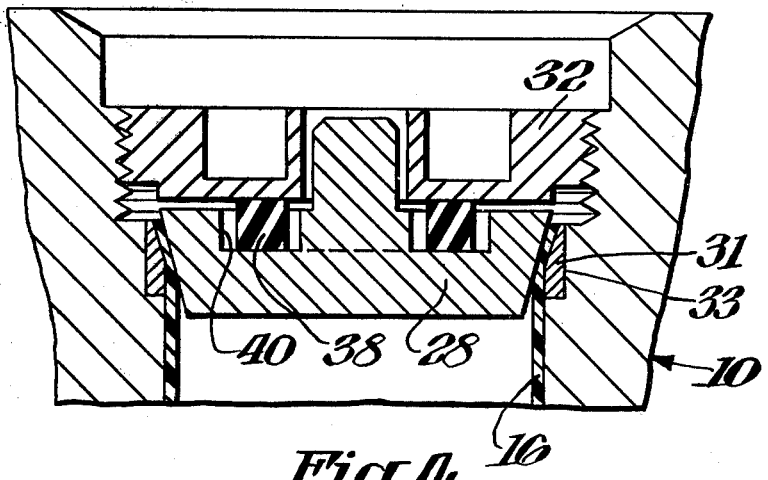
FIG. 3 is a fragmentary, cross sectional elevation view of a rotor seal constructed in accordance with an alternative embodiment of this invention.

In another embodiment of the invention as illustrated in FIG. 3, a flat washer 38 may be used in lieu of the O-ring. The cavity flare may be the same as illustrated in FIGS. 1 and 2, but in this case is illustrated as being provided by a floating ring 31 seated in a counterbore as is described in copending patent application Ser. No. 751,382 filed Dec. 17, 1976 and entitled Centrifuge Tube Enclosure. In this instance, the washer is located in the same positional sense as the O-ring and is positioned within an annular groove 40 having a rectangular cross section formed in the top of the tapered plug. The volume of the groove should approximate that of the solid material of the washer whereas the thickness of the washer should exceed the depth of the groove. In this manner the washer protrudes out of the groove so that it can be compressed by the retaining disc 32. The functioning or operation of the washer is much the same as that of the O-ring and hence need not be described further. Suffice it to say that the materials that may be used for both the O-ring as well as the washer are any suitable resilient material such as rubber, any of the elastomers that are relatively chemically inert, and the like.

Figure 4:
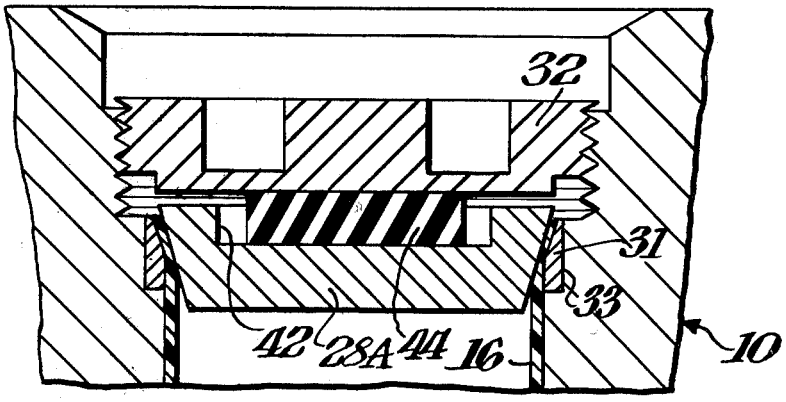
FIG. 4 is a fragmentary, cross sectional elevation view of a centrifuge rotor seal constructed in accordance with still another alternative embodiment of this invention.

In a further embodiment of the invention as seen in FIG. 4, the groove may be omitted from the top of a tapered plug 28A and the plug formed so as to have no stem. In this instance the top of the tapered plug 28A is hollowed to form a disc-like cavity 42 adapted to receive a resilient disc 44 formed the same material as the O-ring of FIGS. 1 and 2. The cavity has a volume substantially the same as that of the disc. The disc 44 is positioned within this recess and is slightly less in diameter initially than that of the recess such that when compressed, the disc entirely fills the volume of the recess. In this manner, the axial thrust so as to urge the plug into the centrifuge tube, is maintained as before.

Figure 5:
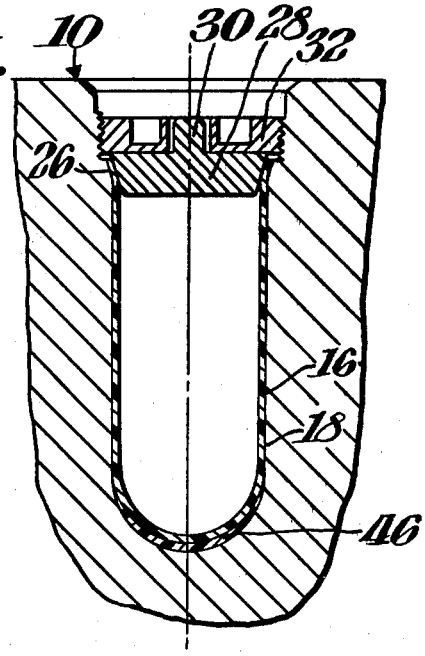
FIG. 5 is a fragmentary, cross sectional elevation view of a centrifuge rotor seal constructed in accordance with an alternative embodiment of this invention in which a resilient disc is positioned at the bottom of the rotor cavity.

Still another alternative embodiment of the invention is illustrated in FIG. 5. A resilient disc 46 may be placed in the bottom of the rotor cavity 18. In this instance, the upper surface of the tapered plug is maintained unchanged; however, the depth of the cavity is increased by an amount roughly corresponding to the thickness of the disc. The disc has a diameter less than that of the cavity such that the compressed disc volume about fills the space between the tube bottom and cavity bottom. The axial force in this instance is provided in an upward sense forcing the tube 16 upward so as to force the plug into the tube. The result is as described previously.

There has thus been described a relatively simple tube sealing mechanism that has particular application on relatively large diameter centrifuge tubes and functions to maintain a continual axial thrust so as to maintain the tubes sealed at all times, even though the sealing plug becomes distorted during use.

In one plug that was built, the annular groove 29 (FIG. 1) has an inside diameter of 0.620 in., a cross sectional diameter of 0.128 in., a depth of 0.075 and the O-ring is $\frac{5}{8}'' \times 13/16'' \times 3/32''$ obtainable from Parker Seal Co., Lexington, Kentucky.

We claim:

1. In a centrifuge rotor for centrifuging a sample in a flexible container having an open end and a first tapered plug for sealing said open end, said rotor having a rotational axis and a radially spaced cavity with a flared open end for said container, said cavity having an axis through said open end generally parallel to said rotational axis, and a retainer secured to said open cavity end for wedging the walls of the open end of said container between said plug taper and said flare, the improvement of:

a resilient member interposed on said cavity axis between said container and plug on the one hand and one of said cavity and retainer on the other, thereby to provide an axial force for maintaining said plug wedged in said container, said plug being movable relative to said retainer transversely of said cavity axis, thereby to maintain the open end of said container sealed.

2. A centrifuge rotor of claim 1 wherein said resilient member is an O-ring.

3. A centrifuge rotor of claim 2 wherein an annular groove is formed in the top surface of said plug for receiving and supporting said O-ring against radial displacement.

4. A centrifuge rotor of claim 3 wherein the volume of said groove approximates that of the volume of the torus of said O-ring and the depth of said groove is less than the diameter of the torus of said O-ring.

5. A centrifuge rotor of claim 1 wherein said resilient member is a flat washer.

6. A centrifuge rotor of claim 5 wherein an annular groove is formed in the top surface of said plug for receiving and supporting said washer against radial displacement.

7. A centrifuge rotor of claim 1 wherein said resilient member is a disc.

8. A centrifuge rotor of claim 7 wherein said disc is positioned on said cavity axis between said container and said cavity.

* * * * *